US005645078A

United States Patent [19]

Marmer et al.

[11] Patent Number: 5,645,078

[45] Date of Patent: Jul. 8, 1997

[54] MOBILE ASSESSMENT APPARATUS AND METHOD

[75] Inventors: Keith S. Marmer, Medford, N.J.; Glenda L. Key, Minneapolis; Richard Brown, Eagan, both of Minn.

[73] Assignee: Key Functional Assessments, Inc., Minneapolis, Minn.

[21] Appl. No.: 315,561

[22] Filed: Sep. 30, 1994

[51] Int. Cl.[6] ..... A61B 5/05

[52] U.S. Cl. ..... 128/782

[58] Field of Search ..... 128/774, 781, 128/782; 33/511, 512; 482/908

[56] References Cited

U.S. PATENT DOCUMENTS

| | | | |
|---|---|---|---|
| 4,135,498 | 1/1979 | McGee | 128/774 |
| 4,742,832 | 5/1988 | Kauffmann et al. | 128/782 |
| 5,080,109 | 1/1992 | Arme | 128/782 |
| 5,088,504 | 2/1992 | Benesh | 128/781 |
| 5,094,249 | 3/1992 | Marras et al. | 128/781 |
| 5,118,101 | 6/1992 | Belli | 482/908 |
| 5,251,644 | 10/1993 | Fitzgerald | 128/782 |
| 5,277,684 | 1/1994 | Harris | 482/908 |

FOREIGN PATENT DOCUMENTS

| | | | |
|---|---|---|---|
| 1487869 | 6/1989 | U.S.S.R. | 128/782 |

OTHER PUBLICATIONS

"Key Method", 2-page brochure, Key Functional Assessments, Inc., 1991.

*Primary Examiner*—Max Hindenburg

*Attorney, Agent, or Firm*—Merchant, Gould Smith, Edell Welter & Schmidt P.A.

[57] ABSTRACT

A mobile assessment apparatus with an assessment unit for testing functional capacity of individuals. The assessment apparatus includes a base attached to vertical supports and a pair of straps which attach the tops of the vertical supports to the base for added stability. The assessment unit is located on the vertical supports and may be moved up or down to adjust a vertical position of the unit. A counterweight apparatus, such as a pair of spring-loaded spools, is attached to the assessment unit so that a user can more easily adjust its position. The assessment apparatus comes apart quickly and easily so that it can fit within a car for transporting the apparatus.

20 Claims, 10 Drawing Sheets

MOBILE ASSESSMENT APPARATUS AND METHOD

FIELD OF THE INVENTION

The present invention relates to systems and methods for assessing the functional capacity of human patients. More particularly, the present invention relates to a mobile assessment apparatus.

BACKGROUND OF THE INVENTION

The human body can suffer from a variety of injuries and conditions which lessen the functional capacity of the individuals to perform employment related activities and/or leisure activities. When an individual suffers from an injury or a condition which lessens the functional capacity of the person, it is sometimes desirable to measure the extent to which the functional capacity has been lessened. Measuring or assessing the functional capacity of the individual patient often involves comparing the patient's functional capacity to the functional capacities of others not afflicted with the injury or condition.

With respect to the upper extremities, it is often important to measure the loss of functional capacity for the arms, the hands, and the fingers, due to an injury or a condition. For example, injuries or conditions resulting from employment related activities may require assessment to evaluate and treat the employee, and to evaluate whether the employee can return to work. Repetitive motion disorders, such as Carpal Tunnel Syndrome, have become significant issues in the work place today. Persons afflicted with such disorders may benefit by a functional capacity assessment.

A variety of functional capacity losses are possible for the upper extremities due to an injury or condition which affects the functional capacity of the upper extremities. For example, the injury or condition may affect the person's ability to move the arms, the hands, and/or the fingers. In addition, the injury or condition may have affected the person's ability to use both hands simultaneously. Hand-eye coordination may be affected in some situations. The person's ability to handle small parts and the person's ability to handle tools may be impacted by the injury or condition. Speed and endurance are two aspects of a person's functional capacity that may also be affected by the person's injury or condition.

During an assessment of a patient, the patient carries out a particular test requiring use of at least some portion of the upper extremity. An observer records data from the test, such as whether the tasks requested of the patient are performed properly and how long the tasks took to be completed. In addition, the observer may look for pain behaviors and pain reports. The pain behaviors relate to movements or non-movements of the patient's body which indicate the presence of pain. Pain reports are statements or comments made by the patient during the assessment which reflect pain being felt by the patient.

Typically, the assessment involves an assessment apparatus used by the patient which permits the observer to collect objective data by watching the patient manipulate or handle objects in a predetermined manner. The objective data may then be compared to some normalized results.

These assessment apparatus are typically permanently mounted to a floor and wall within a health care provider's facility. Accordingly, the patients must come to this health care facility in order to be tested. Many patients, however, are unable to easily travel and thus have difficulty in being tested at the health care facility. In addition, scheduling problems may result in delays in the testing of individuals, and cancellations of appointments result in additional delays. Known transportable assessment devices are limited in use with respect to functional assessments that can be done on the patient.

Accordingly, a need exists for a mobile assessment unit which may be transported to a patient's home, for example, so that it is easier for the patient to obtain testing and more likely that the patient will be tested. In addition, a need exists for an assessment apparatus with an assessment unit which is more easily adjusted for the varying heights of patients to be tested.

SUMMARY OF THE INVENTION

The present invention provides a mobile assessment apparatus for testing functional capacity of patients. The apparatus includes a base coupled to a pair of vertical support members. A horizontal support member connects the upper ends of the vertical support members. A pair of attachment members attaches a horizontal support member at the top of the vertical support members to the base. These components are easily disassembled for transport. An assessment unit is connected to the vertical support members and may slide upward and downward for adjusting a position of the assessment unit. In addition, the assessment apparatus may include a counterweight apparatus for reducing a weight-bearing load of the assessment unit so that it is easier to adjust the vertical position of the assessment unit.

DETAILED DESCRIPTION OF THE PREFERRED EMBODIMENTS

Figure 1:
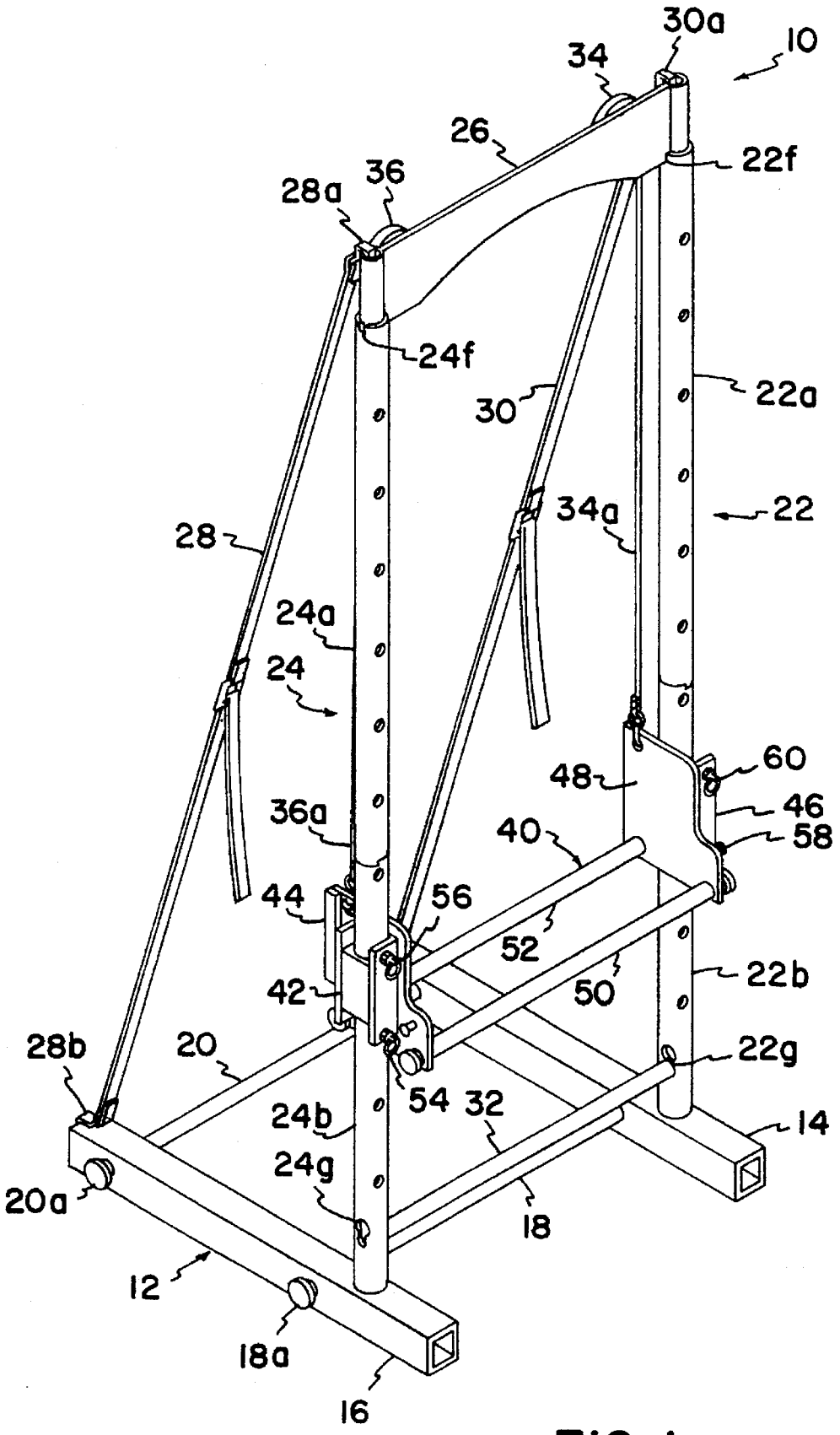
FIG. 1 is a view of the preferred structure of the assessment apparatus when assembled.
Figure 2:
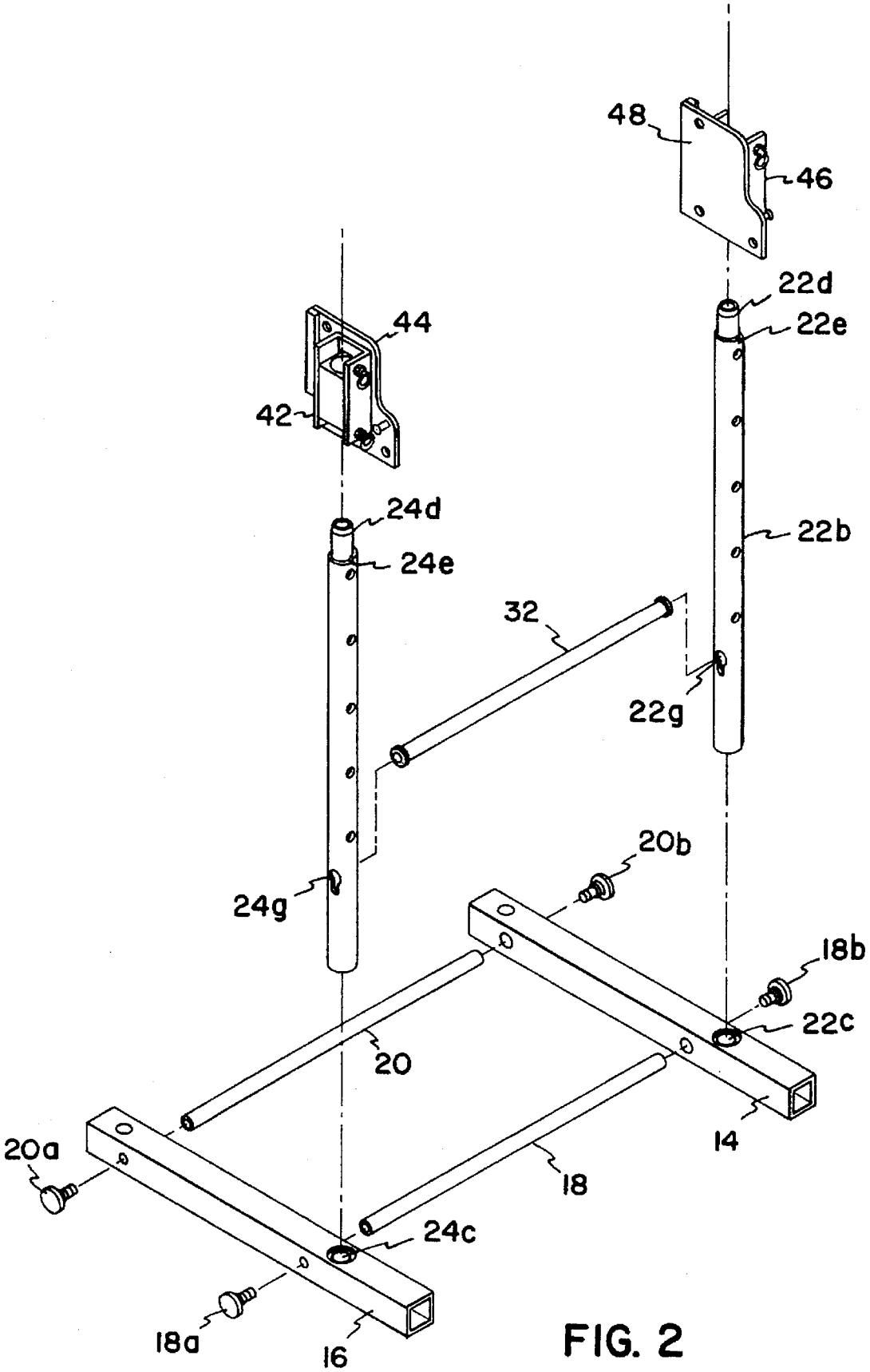
FIG. 2 is an exploded view of a portion of the assessment apparatus of FIG. 1.
Figure 3:
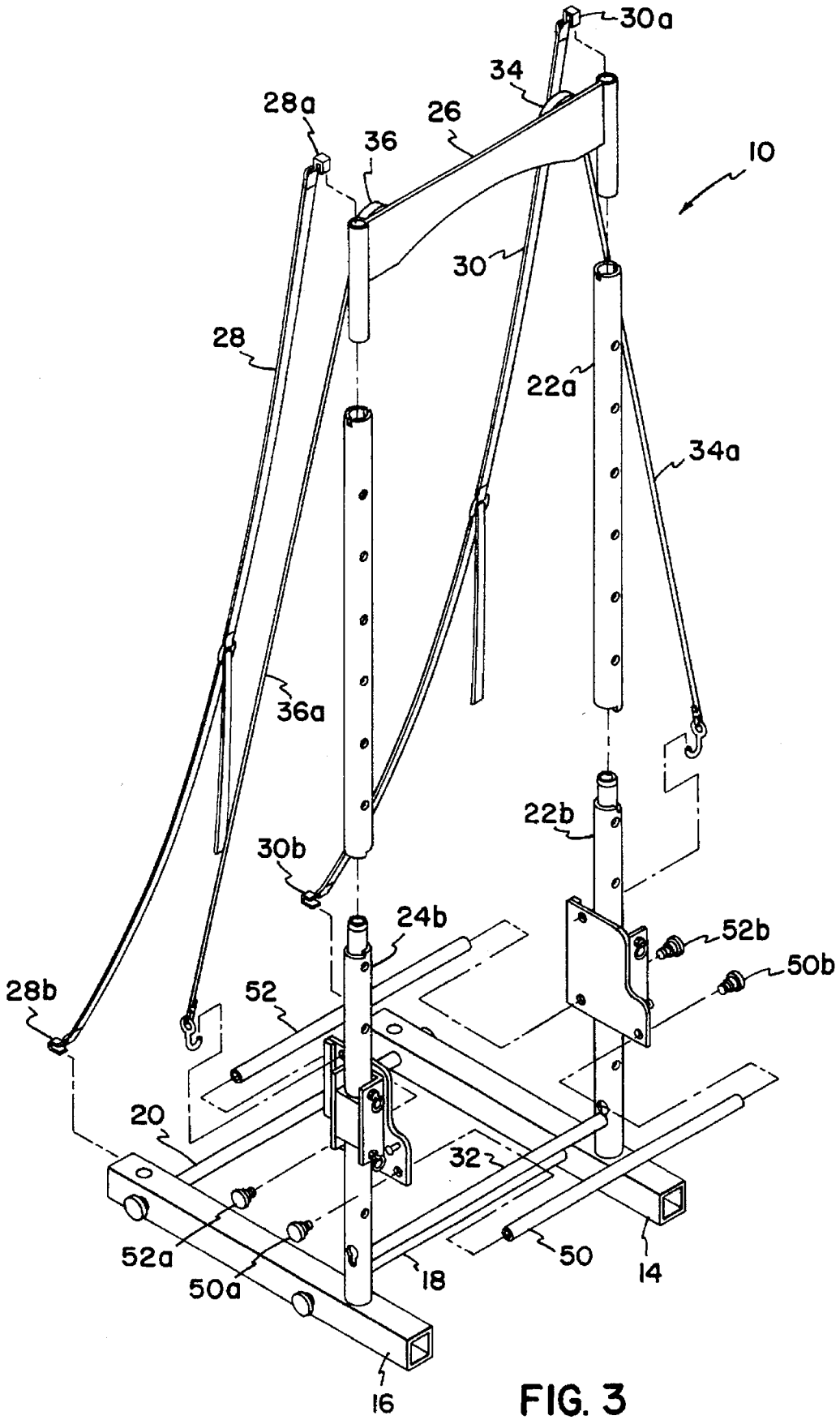
FIG. 3 is an exploded view of the assessment apparatus of FIG. 1 as partially unassembled.

FIG. 1 illustrates a preferred structure for a mobile assessment apparatus. FIGS. 2 and 3 are an exploded view of the assessment apparatus of FIG. 1 as unassembled. As will be described below, the assessment apparatus structure allows it to be easily disassembled for transportability.

Referring to FIG. 1, the assessment apparatus preferably includes a base 12 which comprises support members 14 and 16 that are connected by members 18 and 20. A pair of screws 18*a* and 18*b* fit within the ends of member 18 for connecting it to base members 14 and 16. Likewise, screws 20*a* and 20*b* fit within the ends of cross support member 20 in order to attach it to members 14 and 16 (see FIG. 2).

A pair of vertical support members 22 and 24 fit within the base. Support member 22 preferably includes sections 22*a* and 22*b* which fit together. Likewise, vertical support member 24 preferably includes sections 24*a* and 24*b* which fit together and into the base 12. The use of two individual support sections for the vertical support members allows for more easy transportability due to shorter length tubes. The tops of the vertical support members 22 and 24 are held together by a horizontal support member 26 which preferably fits within key slots 22*f* and 24*f* in the ends of members 22*a* and 24*a* respectively. The vertical support members may also be supported by a second horizontal support 32 which fits within keyholes 22*g* and 24*g* within vertical support sections 22*b* and 24*b* respectively.

A pair of attachment members 28 and 30 connect the top of the vertical support members to the base. The attachment members 28 and 30 are preferably implemented with a pair of nylon straps which include hooks 28*a* and 30*a* for connection into the top of the horizontal support member 26 and a corresponding pair of hooks 28*b* and 30*b* for connection into the ends of members 16 and 14 respectively (see FIG. 3). When the straps are tightened, the downward force on hooks 28*a* and 30*a*, in addition to gravitational force, holds the horizontal support member 26 into the vertical support sections 24*a* and 22*a* and, in addition, holds the sections 22*a* and 24*a* into sections 22*b* and 24*b* and into the base 12. While the straps 28 and 30 are shown attached to support 26, they could alternatively be attached to sections 22*a* and 24*a*.

An assessment unit 40 is coupled to the vertical support members 22 and 24. The assessment unit is used for testing functional capacity of individuals. U.S. Pat. No. 5,251,644 shows an example of an assessment unit and the disclosure of which is incorporated herein by reference. The assessment unit 40 preferably includes a pair of slide blocks 42 and 46 for connection to the vertical support members 22 and 24. A pair of plates 44 and 48 are preferably connected to slide blocks 42 and 46 respectively. The term "blocks" may also correspond to the combination of blocks 42 and 46 attached to plates 44 and 48. A pair of support members 50 and 52 then connect together plates 44 and 48 through the use of screws 50*a* and 50*b* for support member 50 and screws 52*a* and 52*b* for support member 52 (see FIG. 3).

The vertical support members 22 and 24 preferably include a plurality of holes for adjusting a vertical position of the assessment unit 52. The slide blocks 42 and 46 of the assessment unit 40 preferably include pins 54, 56, 58, and 60, which fit within the holes in vertical support members 22 and 24 for adjusting the position of the assessment unit 40. While two pins could be used, the use of four pins increases the stability of assessment unit 40 when used in testing functional capacity of patients. The pins are preferably spring-loaded and positionable between a first position in which they are retracted and allow the assessment unit 40 to slide up and down on the vertical support members 22 and 24, and a second position in which the pins fit within selected holes of the vertical support members 22 and 24, and are held in place by corresponding springs, for securing the assessment unit 40 when used in testing functional capacity of patients. The pins are preferably moved from the first position to the second position by turning one quarter turn.

The assessment apparatus 10 preferably includes counterweight apparatus 34 and 36 for reducing a weightbearing load of the assessment unit 40. The counterweight apparatus 34 and 36 are connected by cables 34*a* and 36*a*, respectively, to plates 48 and 44. The counterweight apparatus 34 and 36 are preferably implemented with spring-loaded spools, such as those which are manufactured by W. W. Grainger. The counterweight apparatus 34 and 36 may be implemented by other means such as counterweights attached by pulleys to the assessment unit 40. The counterweights could be placed within the vertical support members 22 and 24.

FIG. 2 further illustrates how vertical support sections 22*b* and 24*b* fit within the base members 14 and 16. Base members 14 and 16 preferably include pillars 22*c* and 24*c* which fit within the ends of the vertical support sections 22*b* and 24*b*. These pillars allow for easy location of vertical support sections 22*b* and 24*b* within the base and, in addition, provide increased stability.

FIG. 2 also illustrates how vertical support sections 22*a* and 22*b* fit together, and how sections 24*a* and 24*b* fit together. The bottom vertical sections 22*b* and 24*b* preferably include smaller sections of tubing 22*d* and 24*d* which are glued within the ends of these two sections. The outer diameter of sections 22*d* and 24*d* thus nearly equals the inner diameter of sections 22*b* and 24*b*. In addition, the sections 22*b* and 24*b* preferably include notches 22*e* and 24*e*, respectively, to assist the user in lining up the sections 22*a*, 22*b*, 24*a*, and 24*b* such that the holes for positioning the assessment unit are all in alignment.

Figure 4:
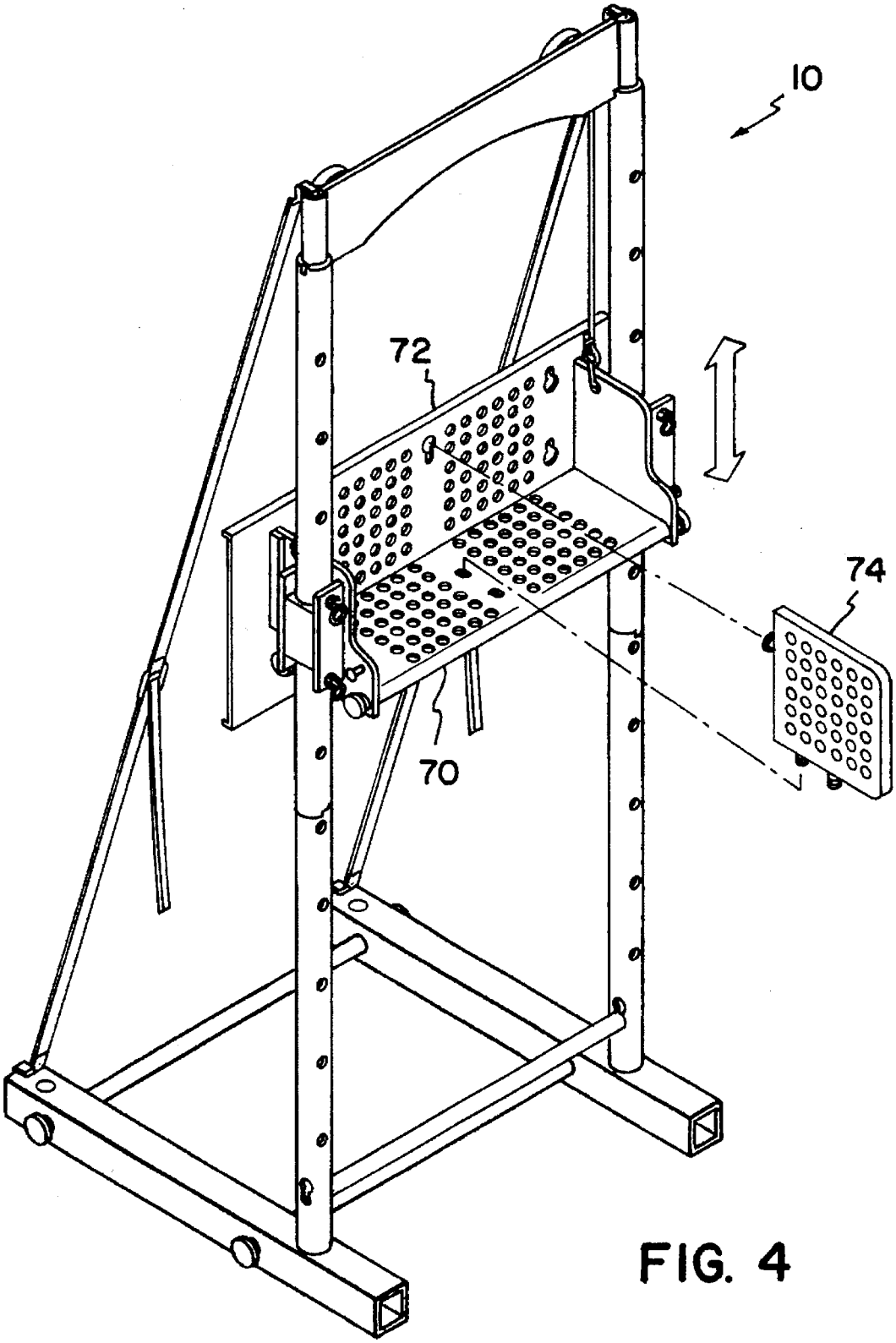
FIG. 4 is a view of the assessment apparatus of FIG. 1 with an assessment unit attached to the apparatus.

FIG. 4 illustrates how additional work surfaces may be added to the assessment unit 40 for use in testing functional capacity of individuals. A bottom section 70 may be placed against support members 50 and 52 (see FIG. 1), and a back section 72 attaches to plates 44 and 48. In addition, a middle section 74 may fit within the bottom section 70 and back section 72. The main surfaces of sections 70, 72, and 74 include a plurality of holes for use in testing functional capacity of individuals. Such testing is explained, for example, in U.S. Pat. No. 5,251,644.

Figure 5:
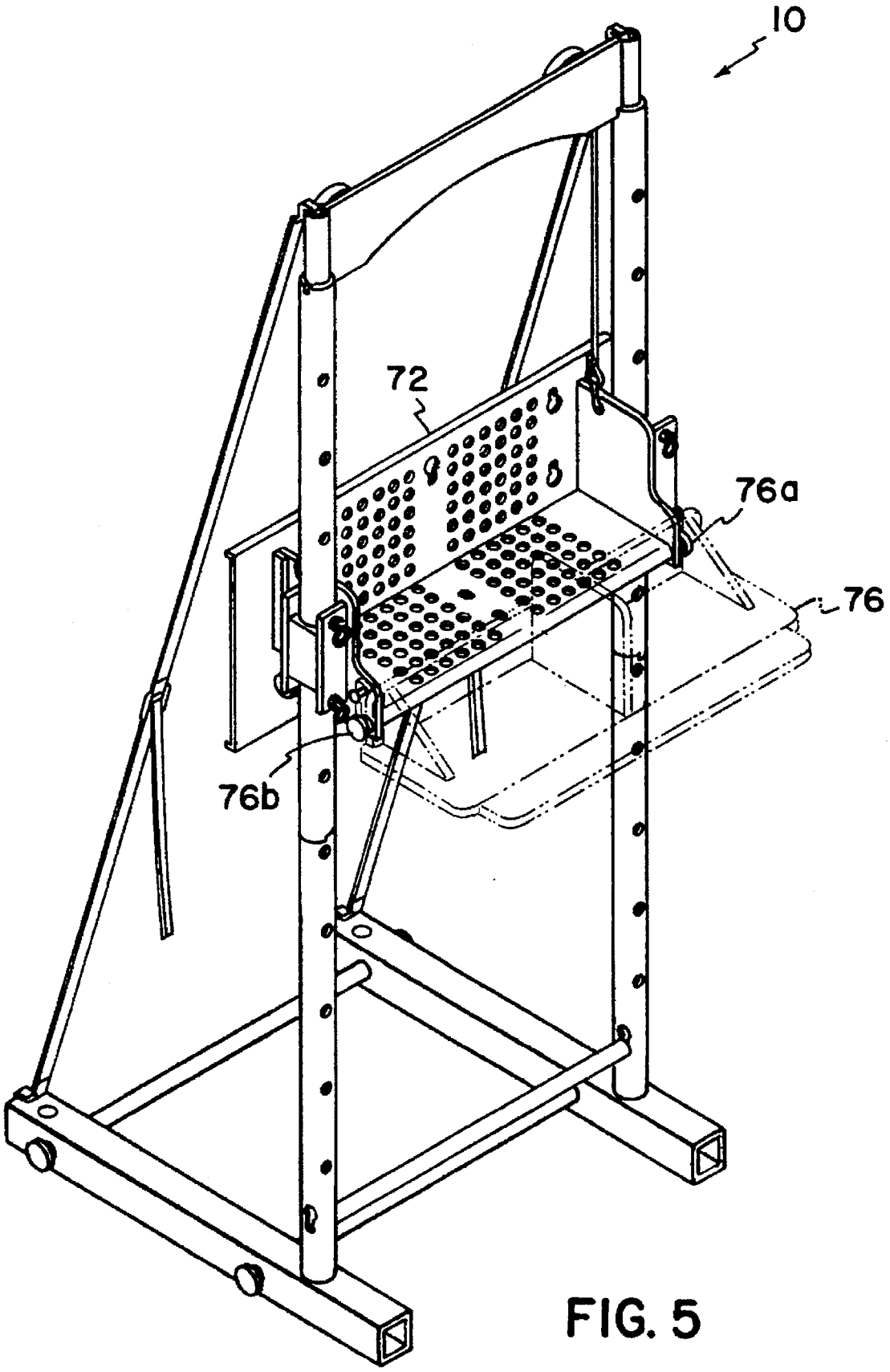
FIG. 5 is a view of the assessment apparatus showing a variation of the assessment unit.

FIG. 5 illustrates the assessment apparatus 10 with an additional unit 76 (in phantom) of the type disclosed in U.S. Pat. No. 5,251,644 and attached to the assessment unit 40. Unit 76 is held in place by screws 76*a* and 76*b*.

Figure 6:
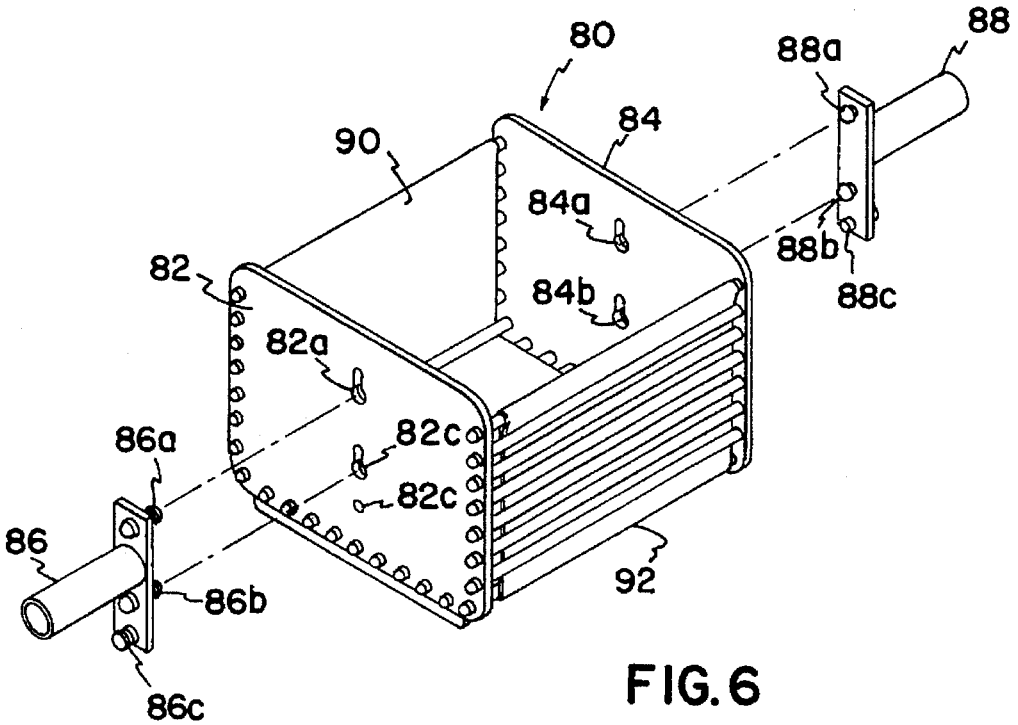
FIG. 6 is a view of a box for use in testing functional capacity.

FIG. 6 illustrates a push-pull box 80 which may be used on assessment unit 40. Push-pull box 80 is preferably assembled from a pair of plates 82 and 84. A handle 86 is attached to plate 82 via pins 86*a* and 86*b* which fit into keyholes 82*a* and 82*b* respectively, and lock 86*c* which fits into slot 82*c*. A handle 88 is attached to plate 84 via pins 88*a* and 88*b* which fit into keyholes 84*a* and 824 respectively, and lock 88*c* which fits into a corresponding slot (not shown) on plate 84. A plurality of rods 92 connect plates 82 and 84. A nylon webbing 90 is placed over the plurality of rods 2 and underneath the corner rods in order to form the basket.

Figure 7:
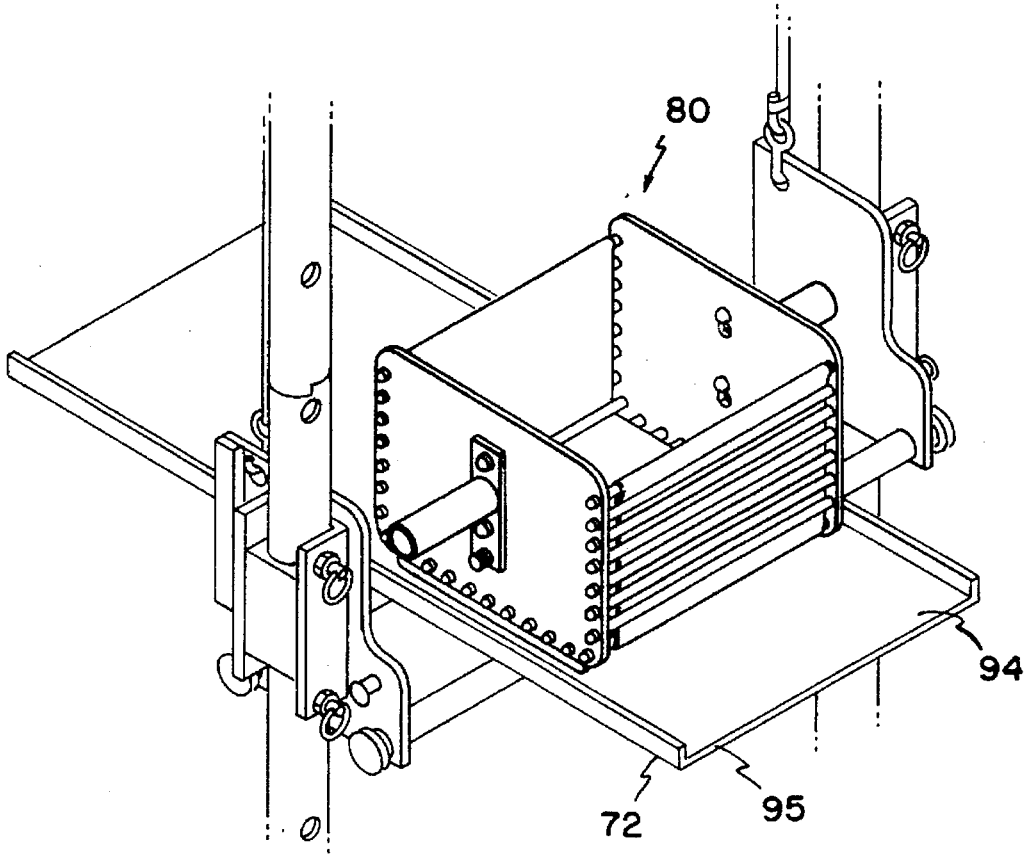
FIG. 7 is a view of the assessment push-pull box on top of a tray of the assessment unit.
Figure 8:
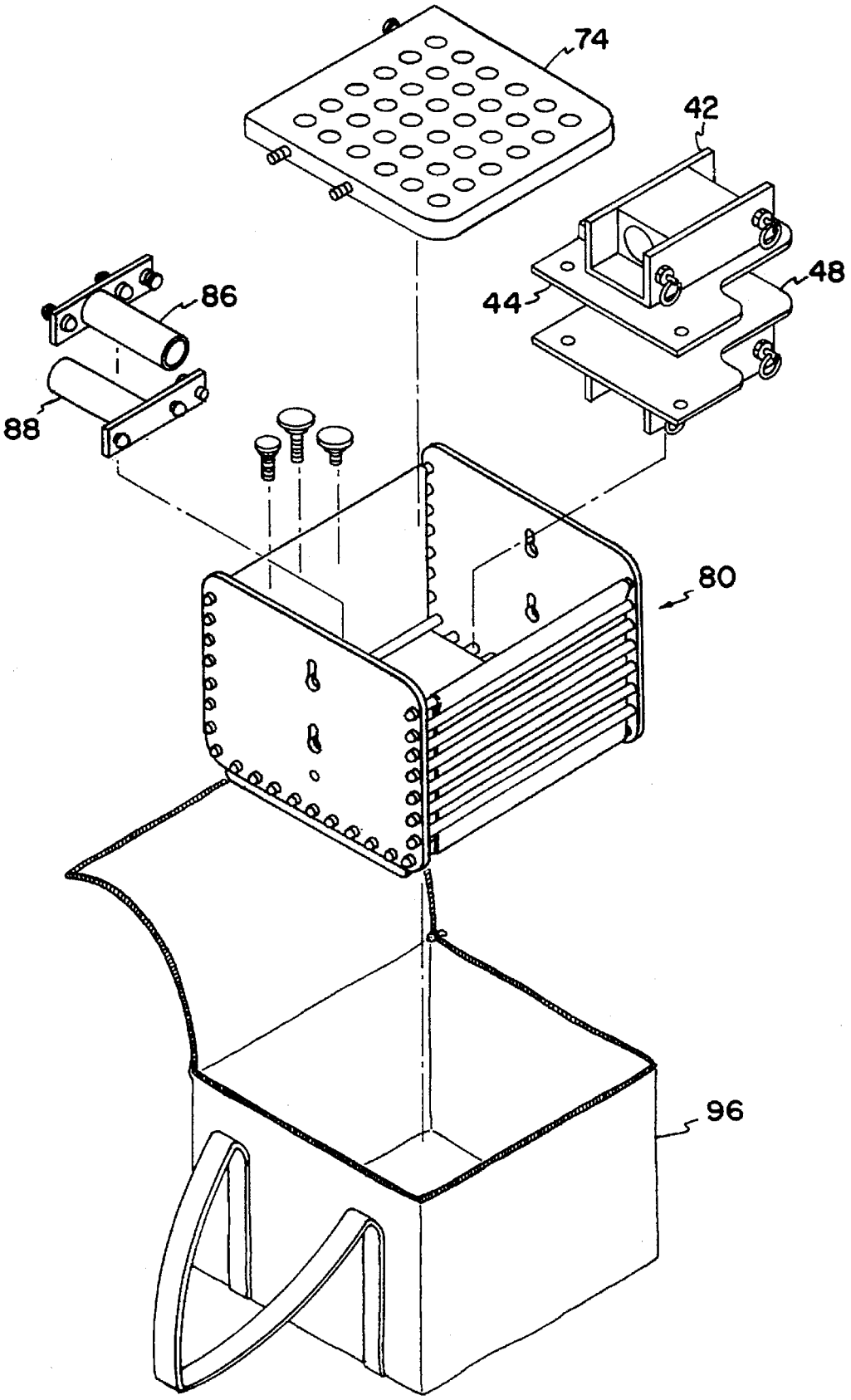
FIG. 8 is an exploded view of the push-pull box as unassembled for placement within a carrying bag.
Figure 9:
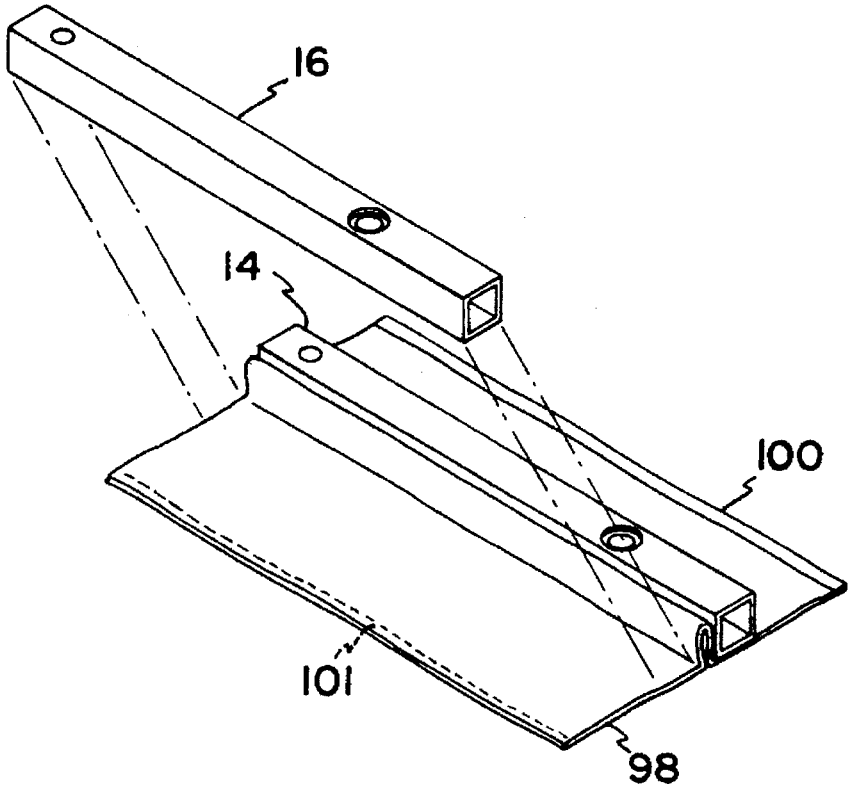
FIG. 9 is a view of unassembled base portions of the assessment apparatus within an open carrying pouch.
Figure 10:
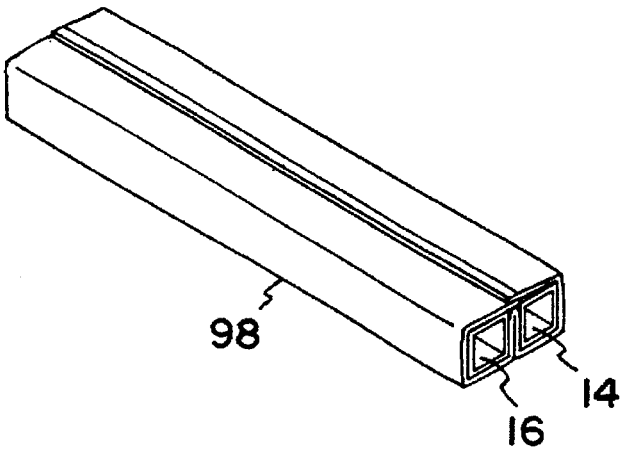
FIG. 10 is a view of the closed carrying pouch for portions of the base of the assessment apparatus.
Figure 11:
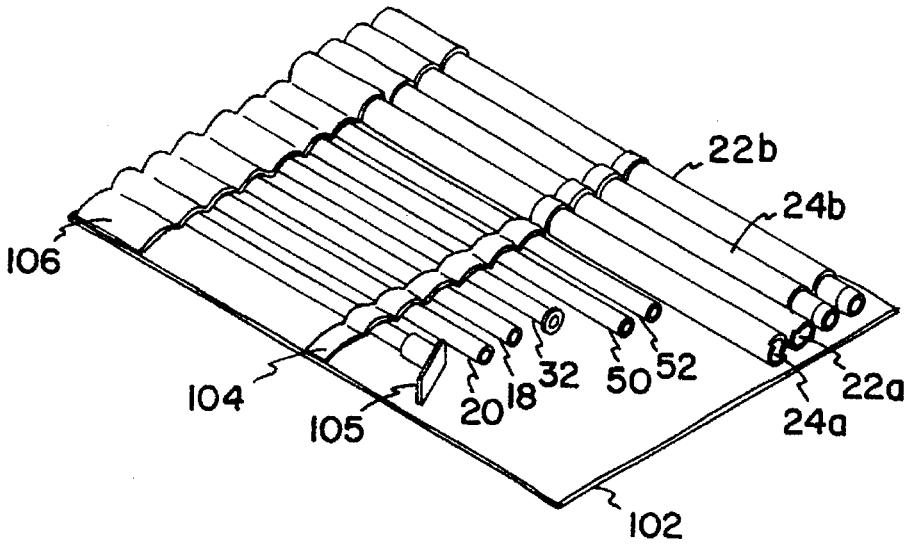
FIG. 11 is a view of portions of the assessment apparatus within a carrying bag.
Figure 12:
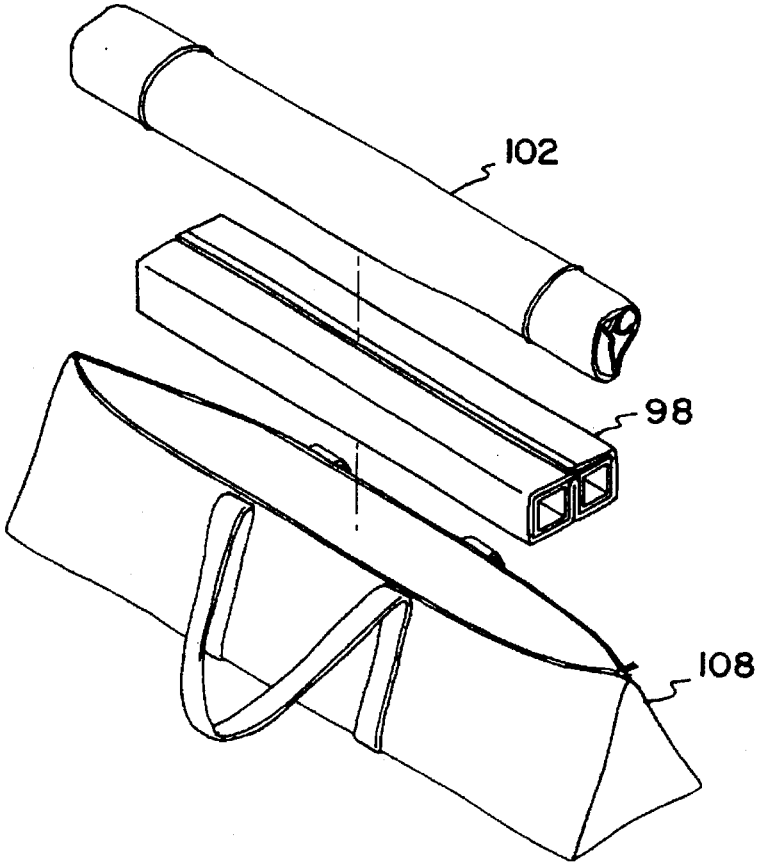
FIG. 12 is a view of the carrying pouch of FIGS. 10 and 11 as fitting within a carrying bag.
Figure 13:
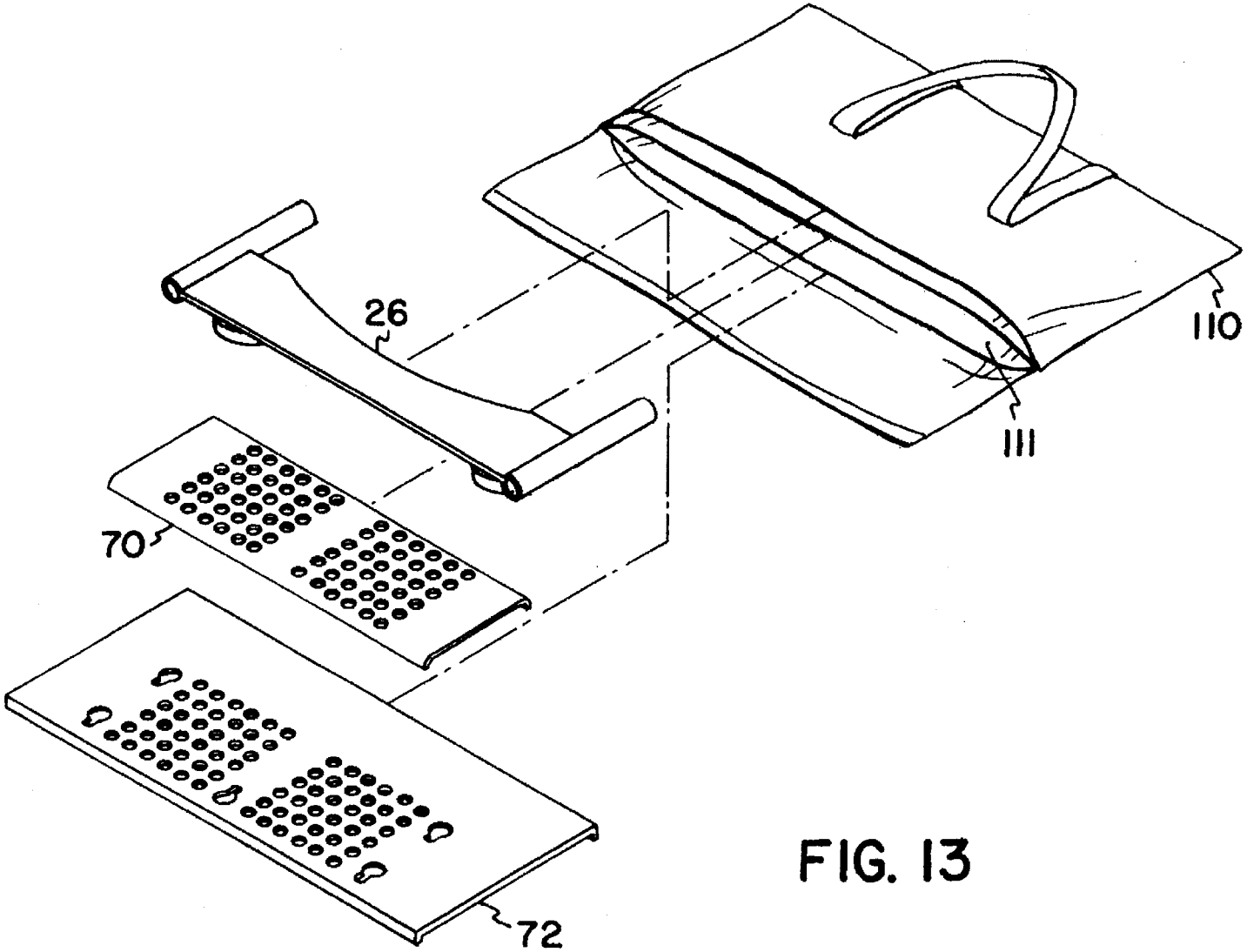
FIG. 13 is a view of portions of the assessment apparatus as fitting within a carrying bag.

FIG. 7 illustrates how the push-pull basket 80 may be used on a push-pull tray of the assessment unit 40. The push-pull tray preferably comprises the back section 72, which in held in place from underneath by screws. A flat painted sheet 94 fits on top of the back section 72. The sheet 94 preferably includes an edge 95 bent at an 85° angle from the surface of the sheet 94 for holding it in place on back section 72. FIG. 8 illustrates how various components may fit within push-pull basket 80 and subsequently be stored within a carrying bag 96 for transportability. FIGS. 9 and 10 illustrate how the base members 14 and 16 may fit within a carrying pouch which, when folded up, is held together by a velcro strips 100 and 101. FIG. 11 illustrates how the various components fit within a carrying pouch 102, which also may include a bar 105 which may be located in one of the base members 14 or 16 and on which functional assessment-related equipment may be mounted. Carrying pouch 102 preferably includes a strap 104 and a plurality of pouches 106 for holding the components in place. Carrying pouch 102 may then be rolled up and, along with carrying pouch 98, placed within a carrying bag 108. FIG. 13 illustrates how additional components of the assessment apparatus 10 may fit within the carrying case 110, which preferably includes a plurality of layers 111 for holding and separating various parts in addition to those shown in FIG. 13. All of these various carrying cases may then easily fit within the trunk of a vehicle for transporting the unassembled assessment apparatus 10.

In summary, the assessment apparatus described in the present specification provides for many advantages. The assessment apparatus provides for ease of assembly through the use of such features as key holes, pillars, notches, slots, adjustable straps, hooks, and slidable blocks, all of which typically do not require tools for assembly. The assessment apparatus also allows for ease of transport because it is easily disassembled and can fit within bags which may fit within the trunk of a car. The assessment apparatus furthermore allows for ease of use through the use of a counterweight and spring loaded pins which makes it easier for a user to adjust a position of the assessment unit, and because the assessment apparatus is adjustable for different tests and/or different patients.

While the present invention has been described in connection with the preferred embodiment thereof, it will be understood that many modifications will be readily apparent to those skilled in the art, and this application is intended to cover any adaptations or variations thereof. It is manifestly intended that this invention be limited only by the claims and equivalents thereof.

What is claimed is:

1. An assessment apparatus for use in testing functional capacity of individuals, comprising:

a base;

a pair of vertical support members extending vertically from the base, each of the vertical support members having a first end detachably connected to the base and having a second end;

a first horizontal support member detachably connected to the second ends of the pair of vertical support members;

a pair of angled support members each detachably connected to the base and proximate to the second ends of the vertical support members. wherein the pair of angled support members each comprise a strap having a first end with a first hook for connection to the base, and a second end with a second hook for connection proximate to the second ends of the vertical support members; and an assessment unit, detachably connected to the pair of vertical support members, for use in testing functional capacity of individuals.

2. The apparatus of claim 1 wherein the base comprises:

second and third corresponding horizontal members each detachably connected to the first ends of the first vertical support members and to the angled support members; and a pair of connecting members each having a first end detachably connected to opposite ends of the second horizontal member and a second end detachably connected to opposite ends of the third horizontal member.

3. The apparatus of claim 2 wherein the second and the third horizontal members each comprise a metal tube having a rectangular cross-section.

4. The apparatus of claim 2 wherein the pair of connecting members each comprising a metal tube and a corresponding screw which detachably connects to ends of the metal tube for securing the tube to the second and the third horizontal members.

5. The apparatus of claim 1 wherein the pair of vertical support members each comprises:

a first section which includes the first end; and a second section which includes the second end, the second section being detachably connected to the first section.

6. The apparatus of claim 5 wherein the first section and the second section each comprise a metal tube having a circular cross-section.

7. The apparatus of claim 1 wherein the first horizontal support member includes first and second sections which detachably fit within the second ends of the pair of vertical support members.

8. The apparatus of claim 7 wherein the pair of angled support members are detachably connected to the first and the second sections of the first horizontal support member.

9. The apparatus of claim 1 wherein the pair of angled support members are detachably connected to the second ends of the vertical support members.

10. The apparatus of claim 1 wherein the assessment unit is slidably connected to the pair of vertical support members.

11. The apparatus of claim 10, further comprising a counterweight apparatus located proximate to the first horizontal support member and operatively coupled to the assessment unit for reducing a weight-bearing load of the assessment unit.

12. The apparatus of claim 11 wherein the counterweight apparatus comprises a spring-loaded spool.

13. The apparatus of claim 10 wherein the assessment unit includes a slide block surrounding each of the vertical support members.

14. The apparatus of claim 13 wherein each of the vertical support members includes a plurality of holes and the slide blocks each include a pin positionable through the slide blocks and into one of the plurality of holes for adjusting the position of the assessment unit.

15. An assessment apparatus for use in allowing a user to adjust a position of an assessment unit connected to the apparatus, comprising:

a base;

a vertical support member mounted on the base and extending vertically from the base;

an assessment unit slidably connected to the vertical support member for testing a functional capacity of an individual; and a counterweight apparatus for reducing a weightbearing load of the assessment unit, the counterweight apparatus being attached to the assessment apparatus and operatively connected to the assessment unit.

16. The apparatus of claim 15 wherein the counterweight apparatus comprises a spring-loaded spool.

17. The apparatus of claim 15 wherein the vertical support member includes a plurality of holes for adjusting a vertical position of the assessment unit.

18. The apparatus of claim 15 wherein the assessment unit includes a slide block surrounding the vertical support member.

19. The apparatus of claim 18 wherein the vertical support member includes a plurality of holes and the slide block includes a pin positionable through the slide blocks and into one of the plurality of holes for adjusting the position of the assessment unit.

20. An apparatus for use in testing functional capacity of individuals, comprising: a base;

two spaced apart and parallel vertical support members mounted on the base and extending vertically from the base, each vertical support member including a plurality of holes;

an assessment unit for testing a functional capacity of an individual; and two spaced apart slide blocks attached to the assessment unit, each slide block slidably connected to one of the vertical support members for allowing a user to adjust a position of the assessment unit on the vertical support members, each slide block including a two position rotatable spring loaded pin mounted to the slide block, each having an extended position and a retracted position, each pin in the extended position positioned through the slide block and into one of the plurality of holes for maintaining the position of the assessment unit, each pin rotatable and lockable in the retracted position for adjusting the position of the assessment unit along the vertical support members.

* * * * *